United States Patent [19]

Sugimoto et al.

[11] Patent Number: 4,774,884

[45] Date of Patent: Oct. 4, 1988

[54] METHOD FOR WASHING A GRAVURE PRINTING SYSTEM

[75] Inventors: Toshiki Sugimoto, Tokyo; Shinya Fujino, Kawagoe, both of Japan

[73] Assignee: Dai Nippon Insatsu Kabushiki Kaisha, Tokyo, Japan

[21] Appl. No.: 820,374

[22] Filed: Jan. 21, 1986

Related U.S. Application Data

[63] Continuation of Ser. No. 812,623, Dec. 23, 1985, abandoned.

[30] Foreign Application Priority Data

| | | | |
|---|---|---|---|
| Dec. 26, 1984 | [JP] | Japan | 59-196123 |
| Dec. 26, 1984 | [JP] | Japan | 59-196125 |
| Dec. 26, 1984 | [JP] | Japan | 59-196126 |
| Jan. 16, 1985 | [JP] | Japan | 60-3969 |
| Jul. 30, 1985 | [JP] | Japan | 60-166779 |

[51] Int. Cl.[4] ..... B41F 9/00; B41F 9/18; B41F 35/02

[52] U.S. Cl. ..... 101/170; 101/152; 101/425

[58] Field of Search ..... 101/425, 423, 152, 153, 101/150, 157, 169, 364, 350

[56] References Cited

U.S. PATENT DOCUMENTS

| | | | |
|---|---|---|---|
| 2,226,311 | 12/1940 | Klingler | 101/157 |
| 2,637,270 | 5/1953 | Bamford | 101/157 |
| 2,650,537 | 9/1953 | Rosse | 101/157 |
| 3,658,003 | 4/1972 | Johnson | 101/157 |

FOREIGN PATENT DOCUMENTS

| | | | |
|---|---|---|---|
| 86757 | 7/1981 | Japan | 101/425 |

*Primary Examiner*—J. Reed Fisher

*Attorney, Agent, or Firm*—Stevens, Davis, Miller & Mosher

[57] ABSTRACT

A gravure printing system comprises at least one printing unit for printing a material fed from a supply side, a washing system for supplying a washing solvent to the printing unit and duct assemblies operatively connecting the printing unit and the washing system. The printing unit comprises unit frames located on both the sides of the printing unit, a plate cylinder supported by support shafts rotatably supported by the unit frames, an ink pan disposed movably to an upper operating position and a lower waiting position, a device for closing an upper opening of the ink pan in the operating position and the plate cylinder above the ink pan, a device operatively connected to the washing system for ejecting washing solvent to the plate cylinder, the plate cylinder support shafts, and the ink pan, a plate cylinder exchanging mechanism for conveying the plate cylinder out of the printing unit to exchange a used plate cylinder with a new plate cylinder. The washings of the plate cylinder and the support shafts therefor and the ink pan are performed by the independent washing solvent ejecting devices at different times suitable for the printing operation in association with the ink pan closing operation. The washing solvent, preferably a non-inflammable washing solvent, used for the washing operation is recovered and reproduced by the reproduction system operatively connected to the washing system for reproducing the used solvent as new washing solvent.

9 Claims, 11 Drawing Sheets

METHOD FOR WASHING A GRAVURE PRINTING SYSTEM

This application is a continuation of application Ser. No. 812,623 filed Dec. 23, 1985 now abandoned.

BACKGROUND OF THE INVENTION

This invention relates to a gravure printing system including a printing unit which effectively carries out a washing operation and a plate cylinder exchanging operation, a washing unit which supplies and recovers washing solvent, and a reproduction system for effectively utilizing the washing solvent. The invention also relates to a method of washing the printing unit.

A gravure printing system generally comprises a paper supply unit, at least one, printing units, a printed paper discharge units, and a washing unit for washing the printing units.

In gravure printing, and particularly, in a case where a film such as a then cellophane is used as a material to be printed, it is required to wash an ink pan and an inking device including an ink circulation unit and also to wash out ink adhering to an outer surface of a plate cylinder in the printing unit at a time when an ink is changed to another color ink regardless of a multicolor or monocolor printing operation.

Recently, it is required for gravure printing technique to print many kinds of materials with a reduced number of lots. This requires much time and labour for frequently exchanging the plate cylinders and washing the inking device and the plate cylinder.

In the conventional technique, the plate cylinder is exchanged by manually holding the plate cylinder or using a conveying bogie provided with a vertically movable support table. The plate cylinder is washed immediately after the printing operation by rotating the plate cylinder at a low speed, pouring a liquid detergent from the upper portion of the rotating cylinder to wash the same, and then wiping off the wet surface of the washed plate cylinder with rags, for example, manually. Regarding the washing technique, the ink pan and associated duct means are first removed from the printing unit and the removed members are conveyed to a washing portion, usually apart from the working portion, at which the removed members are manually washed or washed by using a washing device.

Several problems occur in the printing system of the type described above, and particularly, in the washing operation of the plate cylinder and the inking device and the plate cylinder exchanging operation, as pointed out hereunder.

a. The washing of the plate cylinder of each printing unit requires heavy labour and much time for the workers.

b. The manual plate cylinder exchanging operation using the conveying bogie provided with a vertically movable support requires heavy labour and much time for the workers and also requires disassembly of the inking device which is generally located below the plate cylinder in the printing unit.

c. The removing and conveying works of the ink pan and the associated ducts or pipes to the washing portion requires heavy labour and much time for the workers.

d. The ink adhering to the respective members may often dry as they are conveyed to the washing portion and the washing out of the dried ink further requires much time and labour for the workers and also requires much detergent or another ink removing means, which is not economical.

e. The liquid detergent as a washing agent or solvent to be used is usually a volatile substance the vapour of which is generally harmful to the workers.

In addition, in a conventional technique, and particularly, where the plate cylinder is manually washed, the washing solvent and the used solvent are conveyed to and from the respective printing units by means of conveying bogie or the like, but this method, is not efficient because a large amount of solvent or detergent is required. It is also not economical to throw away the used solvent as it is without reusing the same.

Moreover, many kinds of solutions of organic polymers such as gravure printing inks, oiliness coating materials and coating agents utilize a number of highly inflammable and volatile organic solvents as solvents obtained by combining these organic solvents with specific ratios in accordance their use. These polymer solutions form stiff films on the surfaces of members or units of the printing machine when the solutions volatize and dry, and the washing-out of the dried materials is usually performed by using detergents consisting of organic solvents of substantially similar types to the organic solutions to be used. Thus, the washing operation requires many kinds of organic solvents as detergents, and in addition, the use of volatile and inflammable washing solvents requires much care to exhaust vapours of these washing solvents for safeness and labour for the workers.

SUMMARY OF THE INVENTION

Accordingly, a primary object of this invention is to provide a gravure printing system for eliminating defects or disadvantages encountered in the prior art technique and to provide a gravure printing system including an improved printing unit, a washing unit, and a reproduction system.

Another object of this invention is to provide a printing unit provided with an improved washing solvent ejecting device for automatically and easily washing a plate cylinder and an ink pan and with a sealing mechanism for easily and tightly sealing the opening of the ink pan for safely and securely performing the washing operation.

A further object of this invention is to provide a plate cylinder exchanging mechanism of the printing unit for automatically and securely performing the plate cylinder exchanging operation.

A still further object of this invention is to provide a washing unit of the printing unit for automatically and effectively carrying out the washing solvent supply and the used solvent recovery.

A still further object of this invention is to provide an exhausting device having a simple construction for effectively exhausting air or gas in the printing unit without obstructing the operation of the other units or members in the printing unit.

A still further object of this invention is to provide a reproduction system in association with the washing unit of the gravure printing system for reproducing the used washing solvent as a new washing solvent.

A still further object of this invention is to provide non-inflammable washing solvent specifically prepared for washing the printing unit.

A still further object of this invention is to provide a method for automatically and effectively washing the printing unit.

These and other objects can be achieved in one aspect by a gravure printing system of this invention of the type in which a material to be printed is fed from a supply side is printed and then moved towards a discharge side and the gravure printing system comprises at least one printing unit for printing the material fed from the supply side including unit frames located on both sides of the printing unit, a plate cylinder supported by support shafts rotatably supported by the unit frames, an ink pan disposed movably to an upper operating position and a lower waiting position, a device for closing an upper opening of the ink pan in the operating position and the plate cylinder above the ink pan, a device for ejecting washing solvent to the plate cylinder, the plate cylinder support shafts, and the ink pan, a plate cylinder exchanging mechanism for conveying the plate cylinder out of the printing unit to exchange a used plate cylinder with a new plate cylinder, a washing system for supplying a washing solvent to the printing unit, and duct assemblies operatively connecting the printing unit to the washing system.

In another aspect of this invention, there is provided a method for washing a gravure printing system of the type described hereinabove comprising the steps of closing an upper opening of the ink pan and the support cylinder located above the ink pan with the ink pan closing device after a printing operation, jetting washing solvent against the plate cylinder and the plate cylinder support shafts while rotating the same, releasing the closing of the ink pan closing device and removing the washed plate cylinder out of the printing unit after washing the plate cylinder, closing again the upper opening of the ink pan with the ink pan closing device, and jetting washing solvent against an inner surface of the ink pan.

Furthermore, the washing system of this invention comprises a new solvent storing tank, a supply duct assembly connecting the new solvent tank to the washing solvent ejecting device located in the printing unit, a used washing solvent storing tank, a recovery duct assembly connecting the used solvent storing tank to a bottom of the ink pan for recovering the used washing solvent into the washing solvent storing tank, and a reproduction device operatively connected to the new and used washing solvent storing tanks for reproducing used washing solvent as new washing solvent.

In addition, the washing solvent used in this invention is preferably a non-inflammable solvent consisting of a chlorine-based organic solvent of about 90–60% by volume and a glycol-based organic solvent of about 10–40% by volume.

BRIEF DESCRIPTION OF THE DRAWINGS

In the accompanying drawings:

FIGS. 12A to 13E are schematic views for explaining the plate cylinder exchanging sequence in use of the mechanism shown in FIG. 10.

DESCRIPTION OF THE PREFERRED EMBODIMENTS

Figure 1:
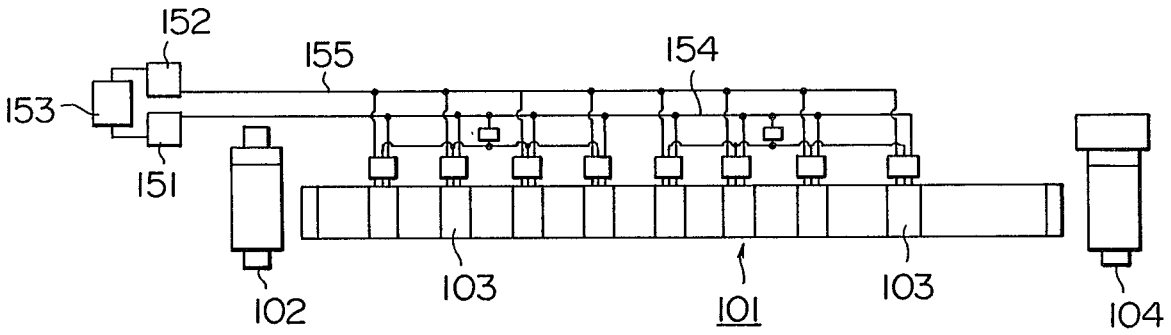
FIG. 1 is a schematic diagram representing a gravure printing system according to this invention.

FIG. 1 shows a schematic diagram of a gravure printing machine 101 according to this invention which generally comprises a paper feeding unit 102, a plurality of printing units 103, and a paper discharging unit 104. A solvent supply main duct or pipe 154 and a solvent recovery duct or pipe 155 are disposed along the printing units 103 and one free ends of these ducts 154 and 155 are connected to a new solvent storing tank 151 and a used solvent tank 152, respectively, which are also connected to a regeneration system 153. The ducts 154 and 155 are operatively communicated with the respective printing units 103 through duct units.

Figure 2:
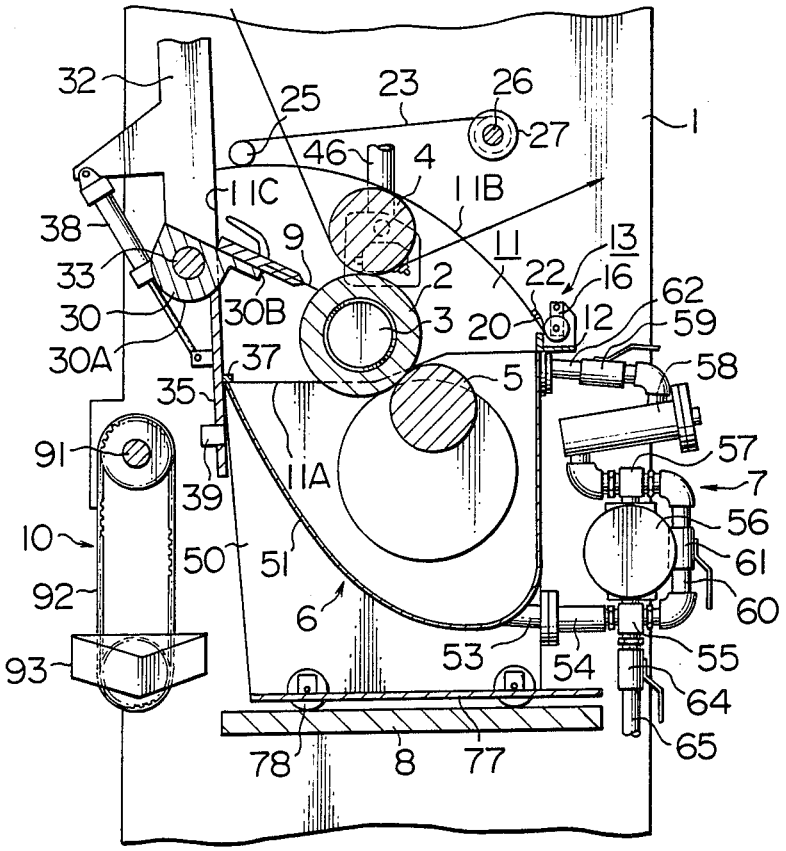
FIG. 2 is a side elevational view of a printing unit of a gravure printing machine according to this invention in which an upper portion of an ink pan is opened.
Figure 3:
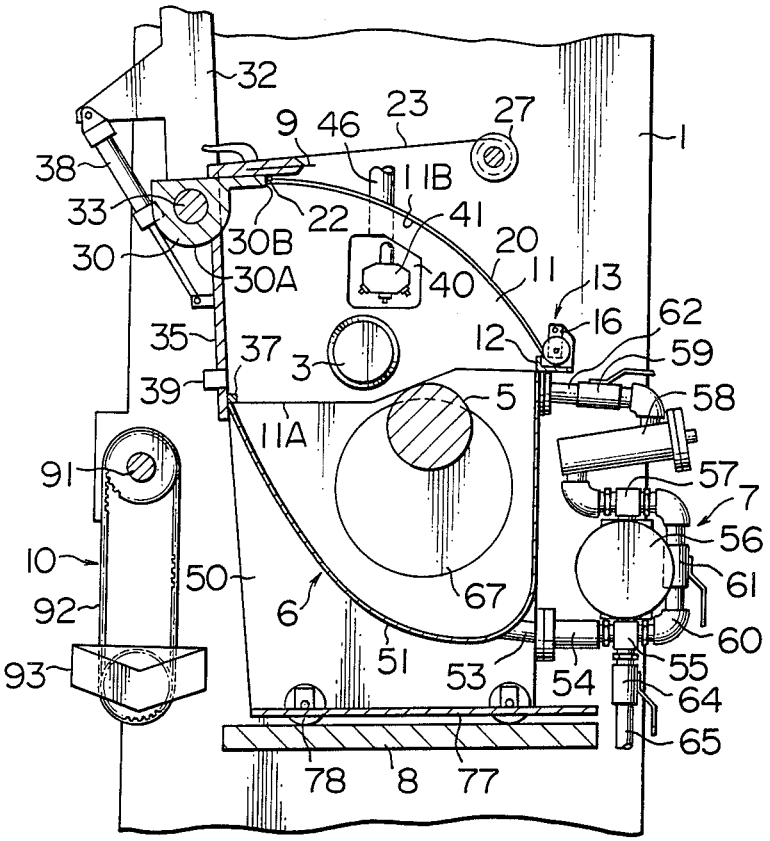
FIG. 3 is a view similar to FIG. 2 in which the upper portion of the ink pan is closed.

FIG. 2 is a vertical sectional view of each of the printing units 103 of the gravure printing machine 101 shown in FIG. 1 as viewed from one side thereof and shows the printing unit 103 under the printing condition. FIG. 3 is also a vertical sectional view, similar to that of FIG. 2, showing the printing unit 103 after the printing operation in which a plate cylinder is removed and an ink pan is tightly closed for a washing operation.

Referring to FIGS. 2 and 3, the printing unit 103 comprises unit frames 1, a plate cylinder 2 supported by support shafts 3 on both sides thereof extending through the unit frames 1, an impression cylinder 4 in contact with the plate cylinder 2, a furnisher roller 5 for supplying a printing ink on the surface of the plate cylinder 2, an ink pan 6, an ink circulation unit 7 secured to the ink pan 6 on the paper discharging side of the printing unit, an elevation table 8 on which the ink pan 6 rests to elevate the same, a doctor 9 for scraping unnecessary ink on the surface of the plate cylinder 2, and a plate cylinder exchanging device 10 operatively attached to the unit frame 1.

The plate cylinder support shafts 3 are rotatably supported by the unit frames 1 and have front ends with reduced diameters or tapered front ends for facilitating the smooth insertion into central holes provided on both end surfaces of the plate cylinder 2.

Figure 6:
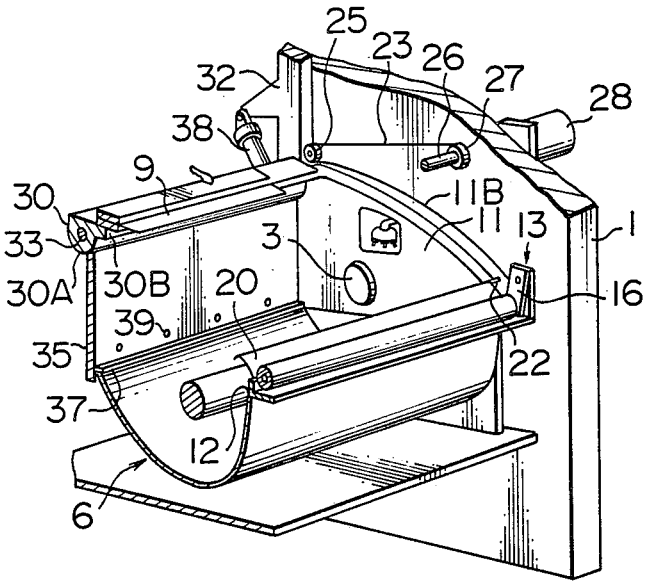
FIG. 6 is a perspective view of an ink pan sealing mechanism, now opened and partially broken away, of the printing unit.
Figure 7:
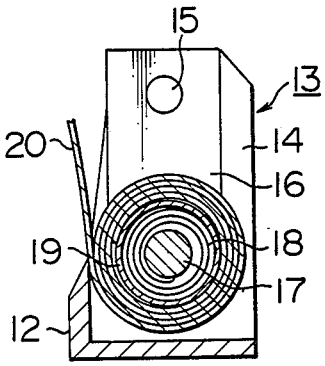
FIG. 7 is a perspective view, partially in section, of a flexible sheet wind-up unit in the printing unit shown in FIG. 2 or 3.

The unit frames 1 on both sides of the printing unit 103 are provided with sealing brackets 11, respectively, which face each other and each of which comprises, on the outer periphery, a lower sealing surface 11A contacting to the upper surface of the end portion of the ink pan 6 for attaining sealing effect, a curved upper sealing surface 11B, and a side sealing surface 11C vertically standing at the one end of the lower sealing surface 11A. A stay 12 and flexible sheet winding members 13 are arranged near the lower end of the upper sealing surface 11B, i.e. near the upper edge of the side portion of the ink pan 6 on the paper discharging side, so as to be bridged across both the sealing brackets 11. The lower surface of the stay 12 forms a sealing surface in tight association with the upper edge of the ink pan 6 for forming a sealing surface. Each of the flexible sheet winding members 13 comprises, as shown in FIG. 7 as an enlarged view, an arm 16 swingably supported by a pin 15 to a bracket 14 at both the ends of the stay 12, a support rod 17 held by the arm 16, and a wind-up core 19 held by the support rod 17 through a spring 18, and a flexible sheet 20 is wound up in roll form around the core 19. The spring 18 always urges the wind-up core 19 in the sheet winding direction. According to this construction, the sheet 20 can be pulled out from the core 19 by pulling the front free end thereof, but by releasing the end the sheet 20 is automatically wound up around the core 19. The upper end of the vertically standing portion of the stay 12 is positioned on substantially the same level of the upper sealing surface 11B of the bracket 11 and the sheet 20 is drawn out over the upper end of the stay 12. As is apparent from FIG. 5, the sheet 20 has a width sufficient to contact the upper sealing surface 11B and acts as a cover to cover an area between the upper sealing surfaces 11B of the sealing brackets 11 located on both sides of the unit frames 1. To the leading end of the sheet 20 is connected a rod 22 having a length longer than the width of the sheet 20 to be movable along the upper sealing surfaces 11B. As clearly shown in FIG. 6, wires 23 are connected to both ends of the rod 22 and the wires 23 pass the upper sealing surfaces 11B and are wound up around pulleys 27 provided for a shaft 26 extending across the unit frames 1 though pulleys 25. The shaft 26 is connected to a reversible electric motor 28 provided with a braking means. The motor 28, the pulleys 27, the wires 23 constitute a drive mechanism for moving the rod 22 along the upper sealing surface 11B. The motor 28 is driven to wind up the wires 23 on the respective pulleys 27 thereby to move the rod 22 towards the doctor 9 along the upper sealing surface 11B, to draw out the flexible sheet 20 and to cover the ink pan 6. On the contrary, when the motor 28 is driven reversely, the wires 23 are wound off thereby to wind up the flexible sheet 20 around the wind-up core 19 and release the upper sealing of the ink pan 6. In addition, when the leading end of the sheet 20 is under restriction, a tension force is applied by the winding force of the spring 18 and the sheet 20 is pressed against the upper sealing surface to seal the same. The tension force applied to the sheet 20 rotates the arm 16 clockwisely to forcibly press the sheet 20 to the upper edge of the stay 12 and simultaneously seal that portion. The sealing of the ink pan 6 by utilizing the flexible sheet 20, the upper sealing surface 11B, and the stay 12 will be attained by forcing the sheet 20 against the upper sealing surface 11B and the stay 12 with frames having shapes corresponding to these members without utilizing the tension force acting on the sheet 20.

The doctor 9 is secured to a doctor holder 30, which is mounted to a shaft 33 held by suspension arms 32, and the doctor holder 30 is movable to take a doctor operating position as shown in FIG. 2 and a raised position as shown in FIG. 3. The doctor holder 30 is provided with an arcuate peripheral surface 30A and a front flat surface 30B, which is positioned at substantially the same level as that of the upper sealing surface 11B so that the rod 22 movable along the surface 11B will abut against this flat portion 30B when the doctor 9 is raised to take a substantially horizontal position as shown in FIG. 3. Below the doctor holder 30 is disposed a sealing plate 35 which is attached to a supporting member, not shown, pivotable about the shaft 33 and which has an upper end rotatably in contact with the outer periphery 30A of the doctor holder 30 to seal the same. The sealing plate 35 has such dimensions as that the sealing plate 35 can contact the side sealing surfaces 11C of both the sealing brackets 11 and the stay 37 across both the sealing surfaces 11C when the doctor holder 30 is in the elevated position as shown in FIG. 3, and the sealing plate 35 is coupled to pneumatic cylinders 38 attached to the suspension arms 32 at both the ends thereof so as to be secured under pressure to the sealing surfaces 11C and the stay 37. According to the structure of the sealing plate 35 together with the associated members, the sealing plate 35 can open or close the area between both the side sealing surfaces 11C. The say 37 bridging across the lower ends of the side sealing surfaces 11C of the brackets located on both sides of the printing unit is provided with a sealing surface closely contacting the upper edge of the ink pan 6 as well as the sealing surface closely contacting a sealing plate 35. As described above, the sealing brackets 11, the flexible sheet winding member 13, the doctor holder 30, the sealing plate 35, and the associated members constitute an ink pan sealing mechanism which surrounds the plate cylinder 2 and covers the upper opening of the ink pan 6. Although in the above embodiment the sealing plate 35 is suspended from the doctor holder 30, the sealing plate 35 may also be held by some holding member not associated with the doctor holder 30 to force the same against the side sealing surfaces 11C and the stay 37.

Figure 3A:
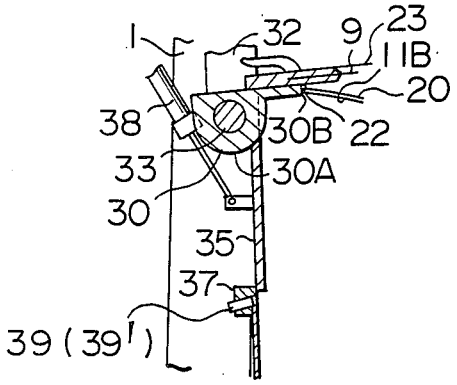
FIG. 3A is a modification of a part of the printing unit shown in FIG. 3.

In addition, in the embodiment of the sealing plate 35 illustrated in FIG. 3, although the sealing plate 35 is so constructed that the lower end of the sealing plate 35 is positioned at the outside of the ink pan 6, the sealing plate could be constructed so that the lower end thereof is positioned in the ink pan 6 so as to be slidable along the inner surface thereof when the sealing plate 35 is lowered as shown in FIG. 3A. This construction of the sealing plate 35 possibly prevents dispersed printing ink or liquid detergent from leaking outwardly through the contact position between the sealing plate 35 and the upper edge of the ink pan 6. In this modification, washing solvent ejecting device 39 (39') as described hereinlater in detail, will be disposed to the stay 37 which is provided outwardly of the upper edge of the ink pan 6.

To the sealing plate 35 is attached a first ejection mechanism provided with a plurality of nozzles 39 (39') for ejecting washing solvent such as liquid detergent for washing the plate cylinder 2. The nozzles 39 are disposed such that the nozzles 39 are positioned below the upper edge of the ink pan 6 in a usual printing operation as shown in FIG. 2, but at portions suitable for ejecting the detergent against the plate cylinder 2 when the sealing plate 35 is raised as shown in FIG. 3. As is apparent from FIG. 5, the nozzles 39 are linearly arranged along the outer peripheral surface of the plate cylinder 2, and both end nozzles 39' within these nozzles 39 are used for washing the support shafts 3 and the other nozzles 39 are used for washing the plate cylinder 2 supported by the shafts 3 at both the ends thereof. For the nozzles 39 (39'), commercially sold nozzles can optionally be bushed, but it may be preferable to use a large flow type nozzle, which conically ejects the detergent, as nozzle 39' for washing the supporting shafts which are likely fouled heavily, and a small flow type nozzle, which ejects the detergent in a flat sector shape, as nozzle 39 for washing the plate cylinder 2. The supply of the liquid detergent to the nozzles 39 and 39' can be made through one supply duct or a plurality of ducts, generally two ducts, as described hereinafter. The location of the nozzles 39 can optionally be changed, and for example, the nozzles 39 may be arranged to a suitable position on the arcuate peripheral surface of the doctor holder 30 so that the nozzles 39 are positioned outward of the sealing plate 35 when the doctor 9 is used as shown in FIG. 2 and positioned in front of the outer peripheral surface of the plate cylinder 2 when the doctor holder 30 is rotated to the position as shown in FIG. 3. In a modification, pipes or rods arranged parallelly with the plate cylinder 2 and provided with a plurality of nozzles are disposed in a retracted condition into the sealing brackets 11 and project the positions facing the outer surface of the plate cylinder 2 at a time of washing the same.

Figure 4:
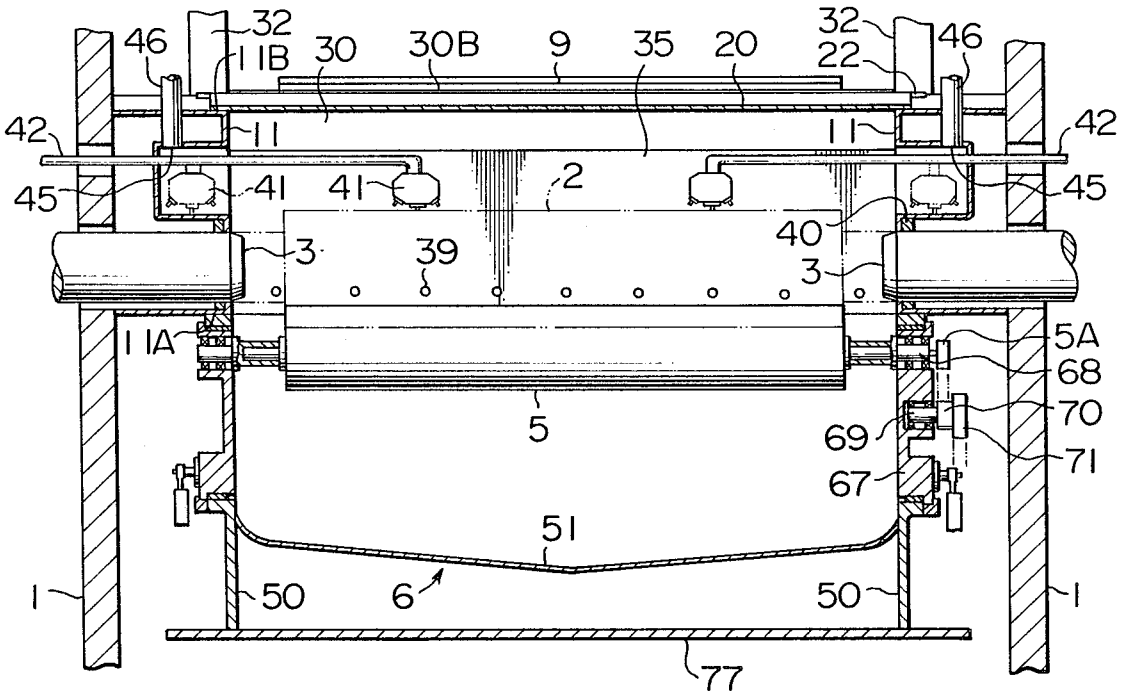
FIG. 4 is a front elevational view of the printing unit shown in FIG. 2 or 3.
Figure 5:
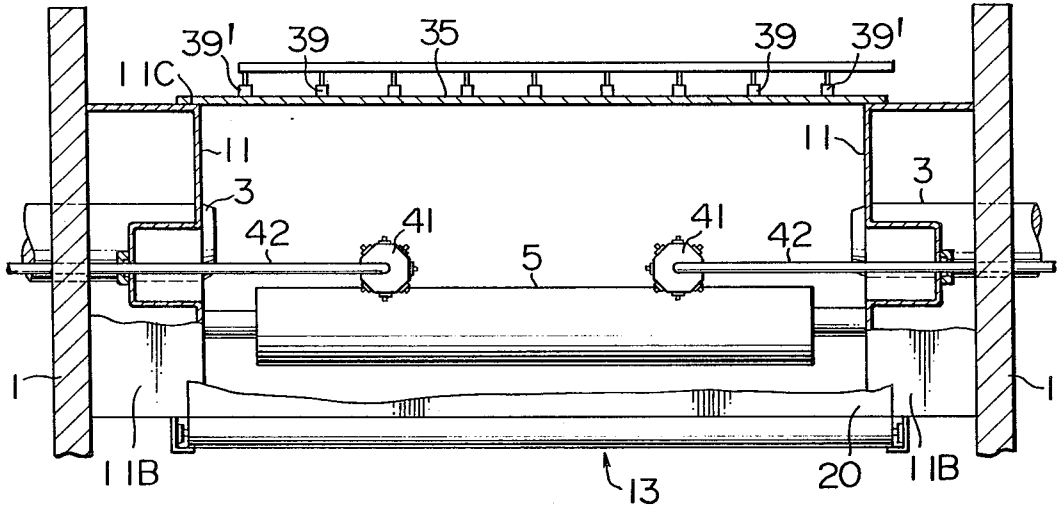
FIG. 5 is a horizontal sectional view of the printing unit.
Figure 8:
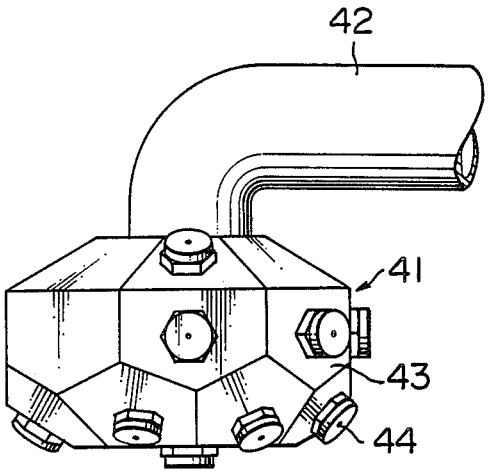
FIG. 8 shows a washing solvent ejecting device located in the printing unit.

The respective brackets 11 are provided with recessed portions 40 facing to each other into which second ejecting devices 41 are accommodated as shown by dot and dash lines in FIG. 4. The second ejecting devices 41 are supported by support pipes 42 respectively extending through the walls of the brackets 11 and the support pipes 42 are connected to a mechanism, pneumatic cylinder means, for example, for moving the pipes 42 in axial directions thereof, thus the ejecting devices 41 can be moved to waiting positions in the brackets 11 and washing positions as shown in FIGS. 4 and 5 with solid lines. Although it is always not necessary to arrange the second ejecting devices 41 in the recesses 40 of the brackets 11 and it is available to locate the same to waiting positions not disturbing the printing operation, it is preferred to locate the devices 41 in the recesses 40 at the waiting time because the devices are hardly fouled in the printing operation. Each of the ejecting devices 41 preferably comprises a block 43 provided with polyhedric surfaces to which the nozzles 44 are located preferably embedded respectively for ejecting the washing solvent as a liquid detergent on substantially the whole surface of the ink pan 6 as shown in FIG. 8. The support pipe 42 acts for supporting the second ejecting device 41 as well as for supplying the detergent to the respective nozzles 44. As a modification of the polyhedric second ejecting device 41, a pipe provided with embedded nozzles and nozzle means revolved by the ejection pressure of the liquid detergent will be preferably used.

Now back to FIGS. 3 and 4, the inking device for supplying ink to the plate cylinder 2 comprises the ink pan 6 and the ink circulation unit 7 located on the side of the ink pan 6, and an ink tank is not used in this printing unit for the purposes of reduced residual ink and easy washing of the ink circulation unit 7. The ink pan 6 comprises both side plates 50 and a body plate 51 located between the side plates 50 and generally provided with a curved bottom as shown in FIG. 2 or 3. As shown clearly in FIG. 4, both the ends of the body plate 51 are also curved and attached to the side plates 50 and inclined towards the central portion of the body plate 51. This arrangement facilitates the washing of the inner surface of the ink pan 6 and the easy flow of the liquid detergent or the like towards the deepest portion of the ink pan 6. Teflon coating on the inner surface of the ink pan 6 is preferred for improving the washing effect.

A connection ipe 53 is connected to the deepest portion of the ink pan 6 and a duct 54 of the inlet side of the ink circulation unit 7 is secured to the connection pipe 53. The ink circulation unit 7 comprises a connector 55, an ink pump 56, a connector 57, a filter 58, a valve 59, a by-pass duct 60, a by-pass valve 61 and an outlet side duct 62 which is secured to the upper portion of the ink pan 6. A member, not shown, suitable for supplying the ink drained into the ink pan 6 through the duct 62 to the furnisher roller 5 is preferably attached to the connecting portion of the duct 62, and a drain duct 65 provided with a drain valve 64 is connected to the connector 55. As the ink pump 56, a diaphragm pump provided with a check valve and driven pneumatically will be preferably used. In case of using the diaphragm pump, the by-pass duct 60 is utilized for draining the residual ink in the duct upstreamside of the pump, and for this purpose, the by-pass valve 61 is closed during the operation of the ink circulation unit 7. On the contrary, in a case where a pump capable of flowing the ink from the upstream side towards the downstream side of the pump under the pump-stopping condition is used, the by-pass valve 60 will be eliminated. A filter provided with a magnet, magnet filter called hereinbelow, will preferably be used as the filter 58 for effectively removing metal powders contained in the ink.

Figure 9:
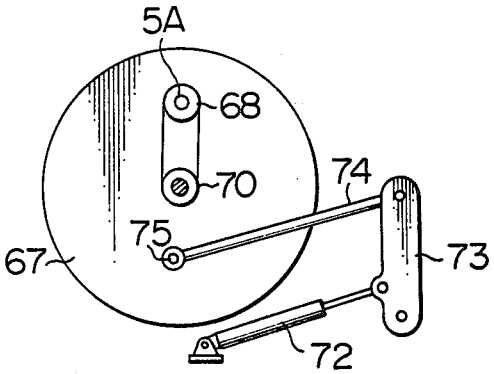
FIG. 9 is a schematic view showing a drive mechanism of a disc supporting a furnisher roller located in the printing unit.

Each of the side plates 50 of the ink pan 6 is provided with a circular hole into which a disc 67 is held rotatably through a sealing member and a bearing as shown in FIG. 4. The disc 67 is held to a plane which is substantially the same plane on which the inner surface of the side plate 50 is laid to facilitate the washing of the side surface of the ink pan 6. The discs 67 support the shafts 5A of the furnisher roller 5 at both the ends thereof through sealing members and bearings at positions eccentric from the centers of the rotation of the discs 67. A pulley 68 is secured to the free end of one of the shafts 5A and the pulley 68 is operatively connected to a pulley 70 of an intermediate shaft 69 held at the central position of the disc 67 as illustrated in FIG. 4. The intermediate shaft 69 supports a pulley 71 which is operatively connected to a drive motor, not shown, to drive the furnisher roller 5 through these members regardless of the rotating direction of the disc 67. A pin 75 is located on the disc 67 outside of the ink pan 6 for operatively coupling a disc rotating mechanism which comprises a pneumatic cylinder 72, a lever 73, and a rod 74, as shown in FIG. 9.

The side plates 50 of the ink pan 6 are also secured to a support table 77 which can be moved by casters 78 assembled therewith. The ink pan 6 is usually mounted or rested on the elevation table 8 of the printing unit.

The printing unit is generally provided with a gas exhausting unit or device for exhausting gases of solvents of the inks used, and washing solvents, and in a conventional printing unit, the gas exhausting device is located below the ink pan and the plate cylinder and provided with a suction opening substantially covering the whole lower portions of the ink pan and the plate cylinder, or is located along the upper edges of the ink pan and the plate cylinder and provided with a long suction opening along the edges thereof. These locations of the gas exhaust devices require much space for location in the printing unit and constitute obstacles during the exchanging operation of the plate cylinder.

According to this invention, as shown in FIG. 4 gas exhausting devices are located in association with the sealing brackets 11 and each of the exhausting device comprises pipe 46 provided with a suction hole opened in the recess 40 of the bracket 11 and an exhausting duct, briefly described hereinlater, connected to the pipe 46 for forcibly sucking and exhausting gas in the printing unit outwardly thereof as occasion demands. The suction pipes 46 may be preferably supported by the brackets 11 through suitable support means. Another exhausting means, not shown, having a relatively simple construction will also be located to the unit frame for facilitating the gas exhausting effect, and it will of course be possible to eliminate this auxiliary exhausting means.

Units or systems for supplying the liquid detergents to the first and second ejecting devices located in the printing unit 1 and for discharging the used liquid detergent will be described hereinafter in detail in conjunction with other accompanying drawings.

Figure 10:
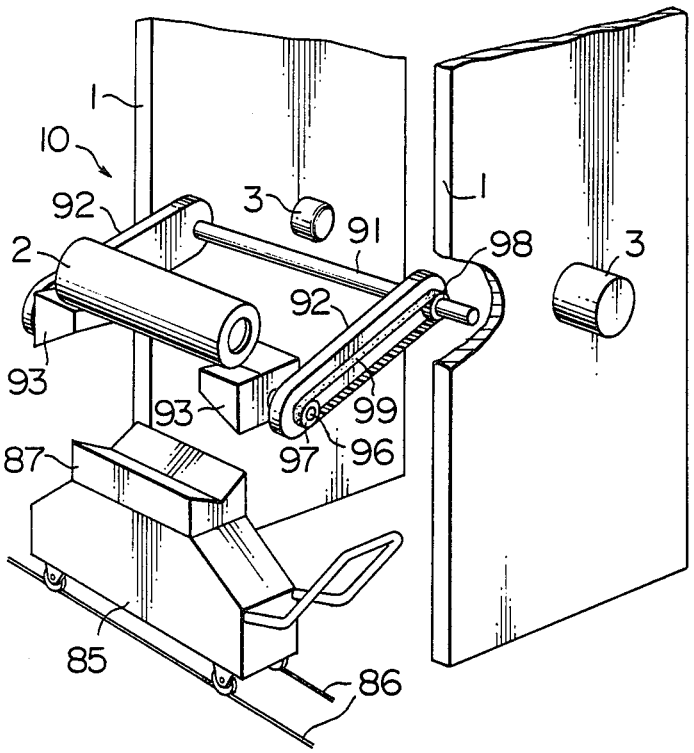
FIG. 10 is a perspective view showing a plate cylinder exchanging mechanism according to this invention located in the printing unit.
Figure 11:
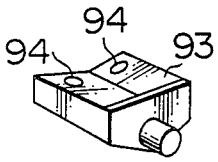
FIG. 11 and FIG. 12 show modifications of a plate cylinder support member of the plate cylinder exchanging mechanism shown in FIG. 10.
Figure 12:
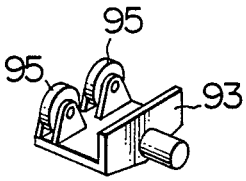

FIG. 10 is a perspective view showing plate cylinder exchanging device 10 in connection with the printing unit 103. The plate cylinder exchanging device 10 comprises drive shafts 91 held rotatably by the unit frames 1 and in parallel with the central axes of the plate cylinder support shafts 3, rotating arms 92 secured to the drive shafts 92 at one ends thereof, the plate cylinder support members 93 rotatably supported by the other end portions of the respective rotating arms 92. The drive shafts 91 are rotatably driven by driving means, not shown, to rotate the arms 92. Each of the plate cylinder support members 93 is provided with a substantially V-shaped upper surface so as to support the outer surfaces of plate cylinders of various types having different diameters. Freely rotatable balls 94 or rollers 95 will be located on the upper surface of the plate cylinder support member 93 in place of the direct support on the V-shaped surface as shown in FIG. 11 or 12. The location of the balls 94 or rollers 95 facilitates the rotation of the plate cylinder 2 thereon and makes easy the alignment of the plate cylinder 2 with the plate cylinder support shafts 3 when the former is inserted between the latter.

A shaft 96 fixed to one end of each of plate cylinder support members 93 is rotatably held by the rotating arm 92, and to one end of the shaft 96 is attached a pulley 97 which is operatively connected through a belt 99 to another pulley 98 mounted rotatably to the drive shaft 91. The pulley 98 is secured to the unit frame 1 by a suitable means so as not to be rotated in accordance with the rotation of the drive shaft 91. According to this construction, even in a case where the arms 92 are rotated by the rotation of the drive shaft 91, the plate cylinder support members 93 attached to the front ends of the arms 92 are not rotated and are held horizontally under the condition in which the plate cylinder support surfaces of the support members 93 are always upwardly directed. These pulleys 97 and 98 and the belts 99 constitute a mechanism for horizontally supporting the plate cylinder support members 93 regardless of the rotation of the rotating arms 92. The horizontally supporting mechanism may be constituted by a link mechanism in place of the mechanism constituted by the pulleys 97 and 98 and the belts 99.

Near the printing unit 103 rails 86 are laid on which a plate cylinder conveying bogie 85 runs and a stopping member, not shown, for positioning the conveying bogie 85 at the predetermined position on the rails 86 is also located. The conveying bogie 85 is provided with a plate cylinder holding member 87 on the upper portion of the bogie 85, and the plate cylinder holding member 87 is preferably provided with substantially the V-shaped upper surface suitable for supporting the central portions of the various types of plate cylinders and having a longitudinal length smaller than the distance between the paired plate cylinder support members 93. The drive shaft 91 of the plate cylinder exchanging device 10 is attached to the unit frames 1 so that the plate cylinder 2 now held by the support members 93 can reach the plate cylinder chucking position and the upper support surface of the plate cylinder holding member 87 of the conveying bogie 85 by the rotation of the rotating arms 92. In greater detail, it is desired that the supporting position of the drive shaft is selected so that the rotating arms 92 are horizontally positioned when the central axis of the plate cylinder 2 held by the support members 93 accords with the central axes of the plate cylinder support shafts 3. This desirable location makes small the horizontal shifting of the rotating arms 92 from the plate cylinder in a case where the central axes of the various types of plate cylinders held by the support members 93 are made to accord with the central axes of the support shafts 3.

In a modification of the plate cylinder exchanging mechanism 10, the plate cylinder support members 93 may be held by rotatable auxiliary arms with respect to the rotating arms 92 or held by a suitable means slidably with respect to the rotating arms 92. According to this modification, the plate cylinder support members 93 can be moved to optionally desired portions, particularly positions in the horizontal direction, in connection with the rotation of the rotating arms 92 thereby to acurately position the center of the plate cylinder 2 held by the support members 93 so as to align with the centers of the support shafts 3 and to rest the plate cylinder 2 on the various positions on the conveying bogie 85.

The duct system for supplying washing solvent as a liquid detergent and recovering the used solvent will be described hereunder in conjunction with FIG. 14.

Figure 14:
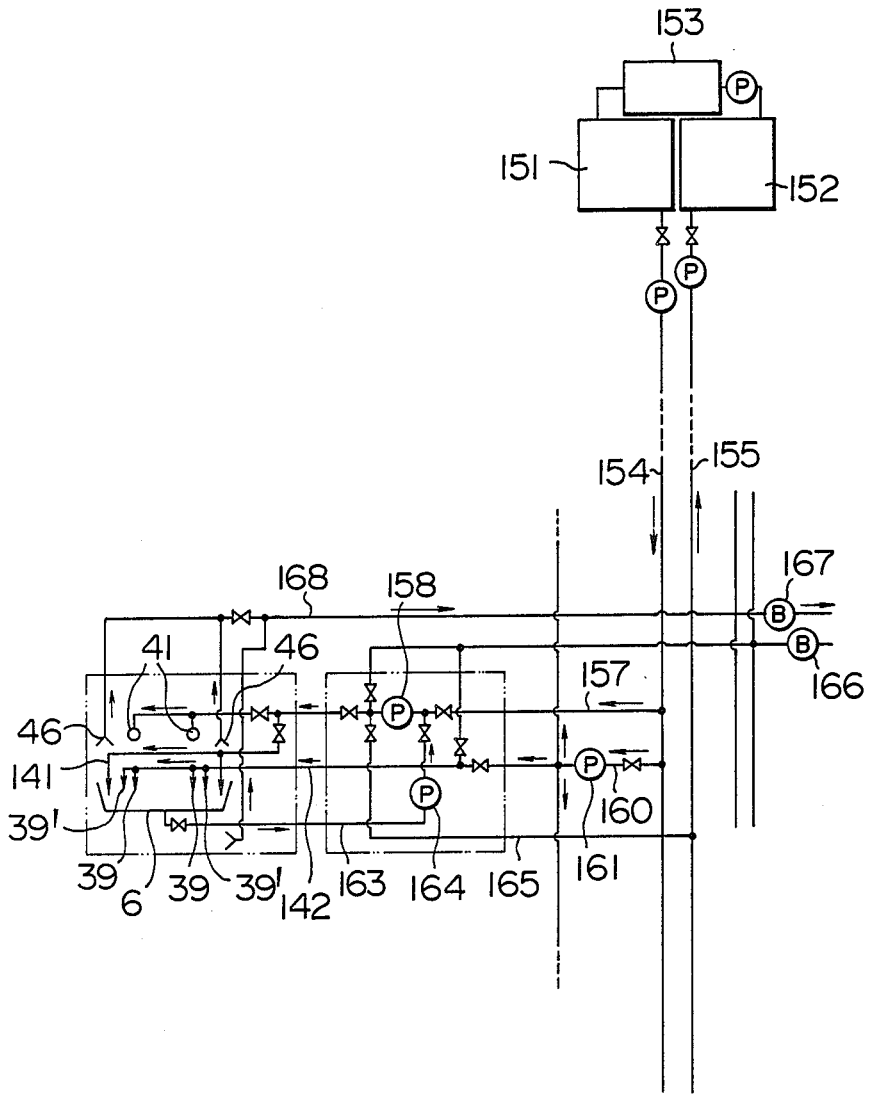
FIG. 14 shows a diagram of a duct arrangement for washing the printing unit shown in FIG. 2 or 3.

Referring to FIG. 14, tanks 151 and 152 for respectively storing new solvent and used solvent are installed near a gravure printing machine and a solvent reproduction system 153 is also installed near the printing machine in operative connection with the storing tanks 151 and 152.

In the tank 151 is stored a solvent as a liquid detergent for washing the plate cylinder and the ink pan in the printing unit and in the tank 152 is also stored a solvent used as a liquid detergent for washing the plate cylinder and the ink pan. The reproduction system 153 operates to heat and distill the used solvent from the tank 152 thereby to obtain the reproduced solvent, which is then stored in the tank 151. A solvent supply main duct 154 and a used solvent recovery main duct 155 extend respectively from the tanks 151 and 152 towards the respective printing units 103, FIG. 1, of the gravure printing machine.

With respect to each printing unit 103, a branch duct 157 extends from the main duct 154 and the solvent supply branch duct 157 is communicated through a gear pump 158 with a duct 141 connected to the nozzles 39' for washing the plate cylinder support shafts 3 and with the second ejecting device 41 for washing the ink pan 6. The supply main duct 154 also branches one solvent supply branch duct 160 for all the printing units 103 and the branch duct 160 is communicated through a gear pump 161 with a duct 142 connected to the nozzles 39 for washing the plate cylinder 2.

A solvent return duct 163 is connected to the bottom of the ink pan 6 through a connection pipe, not shown, at one end and the other end of the return duct 163 is connected to the suction side of the gear pump 158 through a filter 164. As described above, the return duct 163, the gear pump 158, and the duct 141 constitute a circulation duct unit for circulating the solvent in the bottom of the ink pan 6 to the nozzles 39' for washing the plate cylinder support shafts 3. A used solvent recovery duct 165 is connected to the drain side of the gear pump 158 and the recovery ducts 165 of all the printing units are connected to the used solvent recovery main duct 155.

To the drain sides of the gear pumps 158 and 161 are operatively connected a blower 166 for discharging solvent remaining in the respective ducts by blowing air therein, and when an inflammable solvent is used as a detergent, it is desirable to blow an inert gas such as nitrogen gas or carbon dioxide gas instead of air. A blower 167 for discharging the gas in the ink pan, i.e. the printing unit, is arranged to the duct system shown in FIG. 14, and to the suction side of the blower 167 is connected an exhausting pipe, such as shown in FIG. 4 as the exhaust pipes 46, through an exhausting duct 168 for discharging the gas in the ink pan 6.

When an inflammable solvent is used, the inert gas is preferably supplied as occasion demands through the duct assembling the blower 166 for discharging vapor of the inflammable solvent in addition to discharge the remaining solvent.

The printing unit 103 of this invention described hereinbefore will be operated as follows in association with the other units or devices of the printing system, and the operation of the printing unit can be controlled by a suitable controlling device, not shown, which is per se of a well known type for those skilled in the art.

In a usual printing operation, the ink pan 6 takes an elevated position as shown in FIG. 2 and the upper edge of the ink pan 6 is forced against the lower sealing surface 11A of the sealing brackets 11 and the lower surfaces of the stays 12 and 37 to seal the upper edge of the ink pan 6. In this condition, the second ejecting devices 41 for flushing the ink pan are accommodated in the recesses 40 of the respective brackets 11, the flexible sheet 20 is substantially wound up around the wind-up core 19 of the flexible sheet wind-up unit 13, and the rod 22 attached to the front leading end portion of the sheet 20 is positioned near the wind-up unit 13. Under these conditions, the upper opening of the ink pan 6 is not covered with the flexible sheet 20 and is widely opened, so that there exists no obstacle for the pressing of the impression cylinder 4 against the plate cylinder 2 and the passing of the paper to be printed. As occasion demands, the flexible sheet 20 may be drawn out by the operation of the motor 28 through the wires 23 wound up by the pulleys 27, so as to partially cover the upper opening of the ink pan 6, to a position not disturbing the feeding of the printing paper, thereby restricting the scattering of the printing ink and the evaporation of the solvent such as liquid detergent. The sealing plate 35 extending downwardly from the doctor holder 30 is forced against the stay 37 forcing the upper edge of the ink pan 6 to prevent the outward scattering of the ink scraped by the doctor 9. The nozzles 39 (39') constituting the first ejecting device is positioned below the sealing position effected between the stay 37 and the sealing plate 35, so that the nozzles 39 (39') are not soiled by the ink scraped by the doctor 9 or the ink scattered from the plate cylinder 2.

After the printing operation, the impression cylinder 4 is first moved upwardly and the sealing plate 35 positioned below the doctor holder 30 is opened. The doctor holder 30 is then raised to the position shown in FIG. 3 and rotated so that the doctor 9 attached to the doctor holder 30 is moved to take the horizontal position in the printing unit, and the sealing plate 35 is forced against the side sealing surfaces 11C of the brackets 11 and the stay 37 to seal the upper side portion of the ink pan 6. Then the electric motor 28 shown in FIG. 6 is driven it winds up the wires 23 around the pulleys 27 to move the rod 22 attached to the free end of the flexible sheet 20 along the upper sealing surfaces 11B of the brackets 11. When the rod 22 abuts against the flat surface 30B of the doctor holder 30 and stops there, the driving of the motor 28 stops and the braking force is applied thereby to maintain the rod 22 in contact with the flat surface 30B, thus attaining the sealing effect. The flexible sheet 20 covering the upper opening of the ink pan 6 is tensioned by the springs 18 of the wind-up units 13, so that the sheet 20 is forced against the upper sealing surfaces 11B by the self-tension force to tightly seal the ink pan 6. Next, referring to FIG. 7, the tension acting on the flexible sheet 20 swings in the clockwise direction the arms 16 provided with the sheet wind-up cores 19 to force the sheet 20 against the upper edge of the stay 12 thereby to attain the sealing effect at that portion. As described above, the upper portion of the ink pan 6 is sealed by the flexible sheet 20, the doctor holder 30, the sealing plate 35, and the associated portions so as to surround the plate cylinder 2.

After the opening of the ink pan 6 is closed, the remaining ink in the bottom of the ink pan 6 and the ink circulation unit 7 is drained, and the new washing solvent such as liquid detergent is fed to the nozzles 39' for washing the plate cylinder support shafts 3 from the tank 151 through the solvent supply main duct 154 and the gear pump 158 to eject the detergent on the shafts 3 through the nozzles 39' to wash the same while slowly rotating the plate cylinder 2. The supply of the new washing solvent stops at a time when the washing operation has been done to some extent and the washing operation is then again started by using the solvent remaining in the ink pan 6 by circulating the same through the operation of the gear pump 158. A part of the washing solvent ejected from the nozzles 39' is used for washing the plate cylinder 2. During this washing operation, the ink pump 56 of the ink circulation unit 7 is driven to supply the washing solvent in the ink pan 6 to a space between the plate cylinder 2 and the furnisher roller 5 under the condition in which the furnisher roller 5 is forced against the plate cylinder 2. The circulation of the washing solvent through the ink circulation unit 7 performs rough washing of the plate cylinder 2 and the furnisher roller 5 as well as the washing of the ink circulation unit itself. During this operation, it may be preferable that the pressing force of the furnisher roller 5 against the plate cylinder 2 is about 0.5–2.0 $kg/cm^2$ and the peripheral speed ratio therebetween is about $\frac{1}{4}$–1/6. When the washing solvent in the ink pan 6 is heavily soiled during the rough washing of the plate cylinder, the solvent is recovered in the used solvent tank 152 through the used solvent recovery main duct 155 and the new solvent is again supplied from the tank 151 to wash the plate cylinder support shafts 3. After completing the washing of the support shafts 3 and the rough washing of the plate cylinder 2, the driving of the ink pump 56 is stopped and the new washing solvent is supplied to the nozzles 39 from the solvent supply main duct 154 so that the washing solvent is ejected intermittently on the outer peripheral surface of the plate cylinder 2 to wash the same, while the furnisher roller 5 being forced against the plate cylinder 2. After this washing operation, the furnisher roller 5 is separated from the plate cylinder 2 and the new washing solvent is then ejected on the plate cylinder surface to carry out the finish cleaning of the plate cylinder 2.

After the washing of the plate cylinder has been completed, the used washing solvent in the ink pan is recovered in the used solvent storing tank 152 through the recovery duct, and at the same time, air or inert gas is supplied into the duct system for the washing solvent by the blower 166 for discharging the remaining solvent. The outer surface of the plate cylinder is then dried and the vapour of the solvent in the printing unit and the associated units is exhausted by means of the discharging blower 167.

After the completion of the washing operation described above, the ink pan is lowered to remove the washed plate cylinder 2 in the manner described hereinafter with reference to FIGS. 13A to 13E, and the ink pan 6 is then raised. The second ejecting devices 41 for washing the ink pan 6 are forwarded to the operating positions to wash the inner surface of the ink pan by ejecting the washing solvent through the nozzles 44 of the ejecting devices 41. After the completion of the washing of the ink pan, the remaining washing solvent in the duct system is discharged and the vapour thereof is also exhausted by substantially the same manner as described with respect to the washing operation of the plate cylinder. The ink pan 6 is then again lowered and the upper portion of the ink pan is opened for mounting a new cylinder plate in the printing unit.

The plate cylinder exchanging operation will be described hereunder with reference to FIGS. 13A through 13F.

Figure 13A:
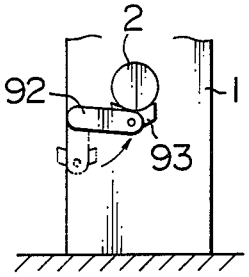

The rotating arms 92 directed downwardly are rotated in an arrowed direction shown in FIG. 13A so that the plate cylinder support members 93 attached to the front end portions of the arms 92 are positioned directly below the used plate cylinder 2 to be exchanged, and under this condition, the used plate cylinder 2 is mounted on the support members 93 by releasing the chucking of the plate cylinder. The arms 92 are then rotated in an arrowed direction shown in FIG. 13B to a position outward of the printing unit and above the upper surface of the support member 87 of the conveying bogie 85. The conveying bogie 85 is then moved so that the upper support member 87 is directly below the plate cylinder 2 supported by the support members 93 and the arms 92 are rotated in an arrowed direction shown in FIG. 13C so that the supported plate cylinder will be mounted on the support member 87 of the conveying bogie 85, thus completing the plate cylinder removing operation.

At the next step, the ink pan 6 is again raised so that the upper edge of the ink pan is forced against the brackets 11 and the lower surfaces of the stays 12 and 37, and the washing of the ink pan 6 is started by the manner described hereinbefore.

After completing the washing of the ink pan 6 and exhausting the gases or vapours of the ink solvent and the detergent used, the ink pan 6 is again lowered for the purpose of mounting a new plate cylinder.

Figure 13D:
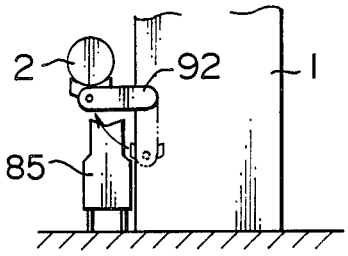
Figure 13B:
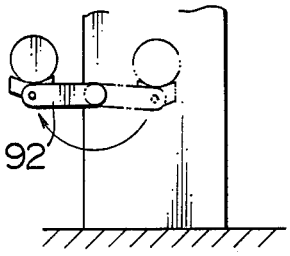
Figure 13E:
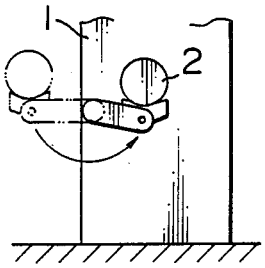
Figure 13C:
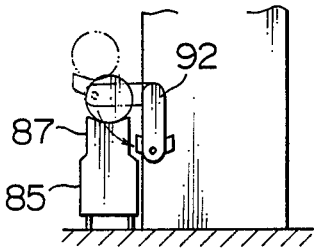
Figure 13F:
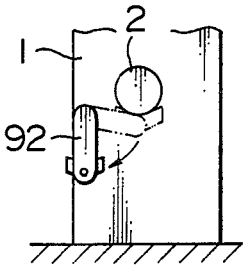

The conveying bogie 85 on which a new plate cylinder 2 is mounted is moved to a suitable predetermined position, and then, the arms 92 are rotated in an arrowed direction shown in FIG. 13D to dip up the plate cylinder 2 and the conveying bogie 85 is moved from the downward position of the dipped-up plate cylinder. The arms 92 are then rotated in an arrowed direction shown in FIG. 13E to the chucking position of the plate cylinder 2 in the printing unit. The plate cylinder support shafts 3 are then moved forwardly so that the front ends of the shafts 3 are inserted into holes formed on the side end portions of the plate cylinder 2 thereby to securely hold the same. In this plate cylinder mounting operation, even if the positions of the support shafts 3 and the plate cylinder 2 are slightly shifted, the insertion will be smoothly performed because the tip ends of the support shafts 3 are tapered. On the contrary, in a case where the phase alignment of the new plate cylinder 2 and the support shafts 3 is required, the plate cylinder 2 or the support shafts 3 will be manually rotated. After the mounting of the plate cylinder 2 to the support shafts 3, the arms 92 are again rotated in an arrowed direction shown in FIG. 13F, thus completing the plate cylinder exchanging operation.

In the operations of the printing unit described hereinbefore, it is preferred that the air or gas in the printing unit is exhausted after the washing operation through the first and second ejecting devices 39 (39') and 41 and before the plate cylinder exchanging operation, and in addition, when the inflammable solvent is utilized as the washing detergent, it is preferred that the inert gas is supplied before all the operations of the printing unit and before the washing operations of the plate cylinder support shafts, the plate cylinder, and the ink pan as well as after the plate cylinder exchanging operation. In other words, briefly speaking, the gas exhaust and the inert gas supply are required immediately before and after the sealing of the ink pan.

Figure 15:
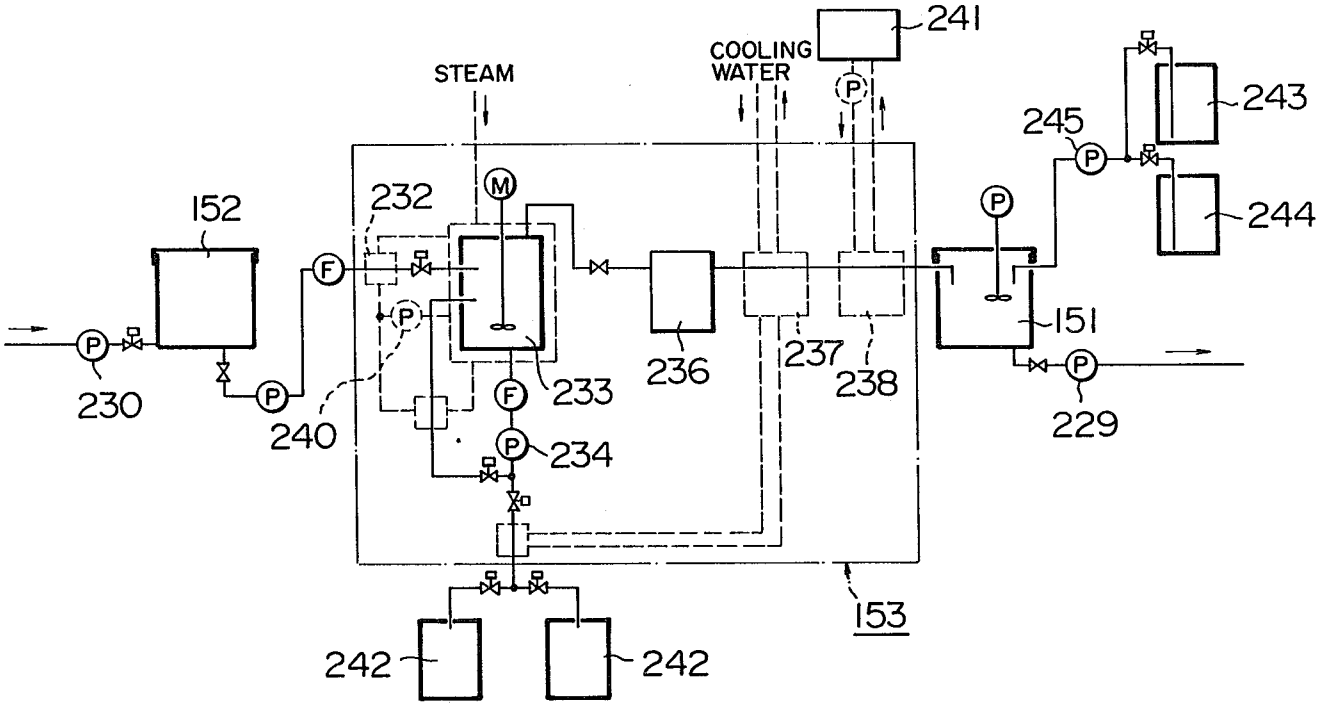
FIG. 15 shows a diagram of a reproduction system for reproducing a washing solvent from a used washing solvent.

The gravure printing system according to this invention further including a solvent reproduction system 153 located in association with the solvent storing tanks 151 and 152 and the reproduction system 153 is as shown in FIG. 15.

The reproduction system 153 generally comprises a preheater 232 for the used solvent, a distilling vessel 233, a pump 234 for circulating the used solvent in the distilling vessel 233, a heater 235, a vacuum pump 236, a condenser 237, and a cooling device 238. A stirrer is located in the distilling vessel 233 for always dispersing residue containing solid materials such as pigment and resin into the solvent to endow fluidity to the solvent. The distilling vessel 233 is provided with a jacket in which is disposed a heating medium which is to be heated by steam and which is then supplied to the preheater 232 and the heater 235 by the operation of a pump 240. Cooling water is supplied to the condenser 237 as a cooling source and a liquid cooled by a refrigerator 241 is also supplied to the cooling device 238 as a cooling source. It should of course be understood that the heating means for the used solvent and the cooling sources for the condenser and the cooling device are not limited to those described above and suitable modifications or alterations can be possibly considered. The lower portion of the distilling vessel 233 is operatively connected to containers 242 through the pump 234 to which a discharge pipe for discharging the residue in the vessel 233 into the containers 242 is arranged. To the new solvent tank 151 is connected a duct assembly including a pump 245 for supplying new solvent stored in containers 243 and 244 to the new solvent tank 151.

The reproducing operation of the used solvent will be described hereunder in conjunction with FIG. 15.

When the used solvent is recovered in the used solvent storing tank 152 and the recovering pump 230 stops, the used solvent is automatically transferred from the tank 152 to the distilling vessel 233. The used solvent is then heated by the preheater 232, the heater 235 and the distilling vessel 233 itself to distil the same. The generated vapour of the used solvent is sucked by the vacuum pump 236 and liquified by the cooling device 238 to transfer the liquified solvent to the new solvent storing tank 151 to reuse the same as new solvent. The used solvent is always stirred in the distilling vessel 233. Generally, the used solvent containing the gravure ink also includes pigment, resin and the like, so that the residue after distillation is formed into sludge which is hard to treat and it is difficult to operate the reproduction system with a high reproducing efficiency. On this point, however, according to this invention, since the used solvent is always stirred on the distilling vessel to always distribute the residue in the solvent, i.e. so as not to separate the solid residue from the liquid solvent, the residue is endowed the fluidity, and therefore, the residue is automatically removed with high efficiency by the operation of the pump even when the reproduction system is operated with a considerably high reproducing efficiency.

When the temperature of the liquid solvent in the distilling vessel 233 (the temperature and the vacuum degree in case of the vacuum distilling operation) reaches a predetermined value, the distillation automatically stops, and thereafter, the residue in the distilling vessel 233 is automatically discharged into the containers 242.

The reproduced solvent is stored in the new solvent tank 151. In a case where the solvent used as a liquid detergent is a mixture of a plurality of solvents, the composition of the solvent reproduced by the distillation will be unwillingly changed to that different from the original solvent and new solvent will have to be automatically fed from the new solvent containers 243 and 244 for adjusting the composition of the reproduced solvent. The supply of the new solvent from the containers 243 and 244 is adjusted by a level meter, not shown, to maintain always constantly the top surface of the solvent in the storing tank 151 for the next washing operation of the printing unit. Although the adjustment of the composition of the solvent in the storing tank 151 can be done by supplying necessary amounts of the respective component solvents of the solvent to be used, in order to avoid troublesome control it is preferred to preliminarily adjust the components of the solvent to be added to supply the insufficient amount of the solvent in the tank 151 so as to maintain the solvent composition in an allowable range thereof.

The above described reproduction operation is automatically controlled or regulated by sensors and controlling means, not shown, but these sensors and controlling means are per se of well known types, so that the description thereof is not made herein.

In the foregoing description of the preferred embodiments of this invention the printing unit is provided with a furnisher roller for supplying ink, but this invention is not limited to this type printing unit and may be applied to another ink supplying system, such as a cascade type printing unit. Moreover, in a case where the furnisher roller is used, a holding member of the furnisher roller is not limited to that illustrated and any modification is applicable, but the illustrated holding member which holds the furnisher roller at an eccentric position of a disc rotatably attached to the side surface of an ink pan can prevent the dispersing of the ink and is easily washed.

According to the gravure printing system of this invention, the plate cylinder, the plate cylinder support shafts and the ink pan can be automatically easily and completely washed without removing the plate cylinder and the inking device, and the respective printing units can be simultaneously washed, thus saving the washing time economically. In addition, the plate cylinder is preliminarily roughly washed by the washing detergent through the ink circulation unit during the washing operation of the plate cylinder support shafts. Since the washing operation can be automatically performed under the closed condition of the ink pan, the workers do not directly handle the washing solvent, thus being sanitary, and in addition, the working environment is not contaminated by vapours of the used solvent. The washing solvent can be itself saved.

Regarding the plate cylinder exchange, since the plate cylinder can be automatically performed only by lowering the ink pan, the work of removing the ink pan as done in the conventional method can be eliminated, thus saving working time and improving the working efficiency.

Furthermore, according to this invention, the printing system includes as improved washing solvent supply and recovery units and a used solvent reproduction system, so that the respective printing units can be simultaneously washed and the supply and recovery of the washing solvent can be effectively performed through duct assembly arranged between the new solvent tank, the used solvent tank, and the reproduction system. The installation of the reproduction system can reproduce the washing solvent which can be effectively stored in the new solvent tank, thus being sanitary and economical. The provision of these washing units or system simplifies the tasks of the workers and makes compact and simple the printing units themselves.

In addition to the merits and advantages of this invention described hereinabove, according to this invention, a number of other advantages and characteristics can be attained, which are described in the proper portions of the foregoing descriptions, for example, regarding the ink pan sealing mechanism, the gas exhausting device, and washing solvent ejecting devices.

Moreover, it will be understood by those skilled in the art that various changes and modifications of this invention can be made within the spirit and scope of the invention.

In the foregoing descriptions of the preferred embodiments according to the gravure printing system, although the types or kinds of the washing solvents as the liquid detergents are not specifically defined, it will be desired to use non-inflammable solvent for the reason described in "Background of the Invention" hereinbefore, but inflammable detergent can be of course used by suitably applying an inert gas such as nitrogen gas or carbon dioxide gas.

More in detail, a chlorine-based organic solvent which is preferably used in this invention as the detergent for the printing unit generally consists of an aliphatic or aromatic hydrocarbon solvent including chlorine atoms in the construction thereof, and more concretely, as the chlorine-based organic solvent is used a chlorinated aliphatic organic solvent such as dichloroethane, trichloroethane, tricloroethylene, and tetrachloroethane, or chlorinated aromatic organic solvent such as chlorobenzene and dichlorobenzene. The aliphatic organic solvent such as trichloroethane and trichloroethylene will be preferably used as the chlorine-based organic solvent.

As a glycol-based organic solvent to be used in combination with the chlorine-based organic solvent of the type described above are availably used monomethyl, monoethyl, monopropyl, and monobutylester of glycol such as ethylene glycol and propylene glycol, and moreover, ester of formic acid, acetic acid or propionic acid of glycol such as ethylene glycol and propylene glycol will be availably used. The monomethyl, monoethyl, monopropyl or monobutyl ester of the ethylene glycol is particularly available.

Although the chlorine-based organic solvent and glycol-based organic solvent of the types described above are per se well known, it is found in experiments of inventors of this application that although the glycol-based organic solvent is per se an inflammable organic solvent, mixture of the glycol-based organic solvent and the chlorine-based organic solvent possesses non-inflammable characteristics with a specific mixed ratio, and that the thus obtained non-inflammable organic solvent mixture provides an excellent washing ability for almost all types of gravure inks and paints and varnishes. More specifically, the mixture organic solvent containing the glycol organic solvent of about 10–40% by volume exhibited the non-inflammable characteristic and the excellent washing ability. The mixture containing the glycol organic solvent less than about 10% by volume exhibited the non-inflammability, but was insufficient in the washing ability and the generality, and the mixture containing that organic solvent over about 40% by volume did not provide the non-inflammability and the generality.

The thus obtained non-inflammable solvent according to this invention possesses excellent mutual solubility with respect to most types of gravure inks and paints and excellent washing ability with respect to the dried films of most types of gravure inks and paints. In addition, since the non-inflammable detergent of this invention can consist of only two organic components, the composition can be easily adjusted in reuse of the detergent once used by applying one of these organic components even the composition of the detergent is changed after once used. On the contrary, regarding the detergent consisting of three or more organic components of conventional type, the adjustment of the components after once used is very difficult.

Accordingly, in use of the non-inflammable detergent of this invention, vessels, machinery, and the like which may be soiled by the gravure inks or paints can be washed safely and sufficiently by preparing only one kind of liquid detergent. As the glycol organic solvent to be used is desirable an ether of an ethylene glycol with alkyl having carbon atoms $C_1$–$C_4$.

One example of the non-inflammable detergent of this invention obtained by preparing mixture solvent with components described will be exhibited hereunder, and in the example, "part(s)" means "%" by volume.

| Example | |
|---|---|
| Non-inflammable Detergent (1) | |
| 1,1,1-trichloroethane | 80 parts |
| Ethyleneglycol Monomethyl ether | 20 parts |
| Non-inflammable Detergent (2) | |
| Trichloroethylene | 70 parts |
| Ethyleneglycol Monobutylether | 30 parts |
| Non-inflammable Detergent (3) | |
| Tetrachloroethane | 85 parts |
| Ethyleneglycol Monomethylether | 15 parts |

In the washing operation of a gravure printing machine the printing operation of which was interrupted, the non-inflammable detergent (1) attained the excellent washing effect and the dried ink after the interruption could be washed sufficiently by the non-inflammable detergent (1). Regarding the non-inflammable detergents (2) and (3), substantially the same sufficient washing results could be obtained. These non-inflammable detergents (1) to (3) were also available for washing a coating machine.

What is claimed is:

1. A method for washing a gravure printing system and for changing a plate cylinder thereof, said system having a printing unit comprising said plate cylinder, an impression cylinder disposed above the plate cylinder in contact therewith; a furnisher roller disposed below the plate cylinder in contact therewith; an ink pan disposed below said furnisher roller and having an upper opening; means for sealingly closing the upper opening of the ink pan so as to isolate a space including the interior of the ink pan and a space in which said impression and plate cylinders and said furnisher roller are located; a washing solvent ejecting means for ejecting a washing solvent; and ink circulation means connected to the ink pan, said method comprising the steps of:

removing said impression cylinder after a printing operation; then closing the upper opening of the ink pan with said closing means;

ejecting a new washing solvent into the isolated space against the plate cylinder by said washing solvent ejecting means, while rotating the plate cylinder, to wash the plate cylinder and recovering the washing solvent in the ink pan;

stopping the ejection of the new washing solvent;

circulating the washing solvent collected in the ink pan by said circulation means to wash the ink circulation means, and ejecting the circulating washing solvent against the plate cylinder to carry out rough washing of the plate cylinder and the furnisher roller;

ejecting a new washing solvent into said isolated space to finish cleaning the plate cylinder;

recovering the used washing solvent collected in the ink pan; then lowering the ink pan from an initial position;

opening the upper opening of the ink pan by releasing said closing means;

removing the plate cylinder;

installing a new plate cylinder; and raising the ink pan to the initial position.

2. The washing method according to claim 1 wherein said washing solvent is a non-inflammable solvent consisting of a chlorine-based organic solvent of about 90–60% by volume and a glycol-based organic solvent of about 10–40% by volume.

3. The washing method according to claim 2 wherein said chlorine-based organic solvent consists of an aliphatic organic solvent.

4. The washing method according to claim 2 wherein said glycol-based organic solvent consists of an ether of an ethyleneglycol with alkyl having carbon atoms $C_1$–$C_4$.

5. The washing method according to claim 1 wherein the washing solvent ejecting means for ejecting the washing solvent for washing the ink pan is advanced from a retracted position when the solvent is to be ejected.

6. The method according to claim 1, further comprising the steps of: ejecting a washing solvent on the inner surface of the ink pan to wash the same after raising the ink pan to the initial position and after closing the upper opening of the ink pan; and lowering the ink pan while opening the upper opening of the ink pan, before the step of installing the new plate cylinder.

7. The method according to claim 6 wherein the steps of ejecting the new washing solvent into the isolated space and the step of ejecting the washing solvent at the inner surface of the ink pan are carried out by different solvent ejecting means.

8. The method according to claim 5 wherein the washing solvent ejecting means for ejecting the washing solvent, and for washing the ink pan, is advanced along the longitudinal direction of the plate cylinder.

9. The method according to claim 1, further comprising the step of supplying an inert fluid into the printing unit for drying the unit and exhausting the vapor of the solvent after the step of recovering the used solvent.

* * * * *